US005535612A

United States Patent [19]

Vijayakar

[11] Patent Number: 5,535,612

[45] Date of Patent: Jul. 16, 1996

[54] METHOD AND APPARATUS FOR DRAWING WIRE THROUGH A PLURALITY OF STANDARD DIES AT THE DIE POSITIONS

[75] Inventor: Sameer S. Vijayakar, Akron, Ohio

[73] Assignee: The Goodyear Tire & Rubber Company, Akron, Ohio

[21] Appl. No.: 327,385

[22] Filed: Oct. 21, 1994

[51] Int. Cl.[6] ..... B21C 1/04

[52] U.S. Cl. ..... 72/43; 72/289; 72/280

[58] Field of Search ..... 72/280–282, 289, 72/43, 44, 467

[56] References Cited

U.S. PATENT DOCUMENTS

| | | | |
|---|---|---|---|
| 2,203,751 | 6/1940 | Simons | 72/282 |
| 2,715,959 | 8/1955 | Zelley . | |
| 3,213,663 | 10/1965 | Coan | 72/282 |
| 3,486,361 | 12/1969 | Vaneman et al. . | |
| 3,664,169 | 5/1972 | Henrich . | |
| 3,686,908 | 8/1972 | Krafft | 72/289 |
| 3,955,390 | 5/1976 | Geary . | |
| 4,750,344 | 6/1988 | Thompson | 72/280 |
| 4,960,473 | 10/1990 | Kim et al. . | |
| 5,189,897 | 3/1993 | Lionetti et al. . | |

FOREIGN PATENT DOCUMENTS

| | | | |
|---|---|---|---|
| 1181963 | 6/1959 | France . | |
| 154839 | 6/1994 | Japan | 72/282 |

OTHER PUBLICATIONS

A. Brownrigg, R. Boelen & M. Toyama–BHP Melbourne Research Laboratories, Clayton, Victoria, Austrialia, Dec. 1984, *Delamination of Hard Drawn Eutectoid Steel Wires*, pp. 1431–1438, AFR vol. 2–V.

Z. Zimerman, Aug. 1988, *Making Quality Steel Wire At Optimum Productivity*, pp. 50–61, Wire Journal International.

E. Aernoudt, Mar. 1983, *Materials Response To Wiredrawing*, pp. 53–75, Wire Journal International.

C. K. Lanner, May 1983, *Strain Aging In Cold–Drawn Wire*, pp. 15–23, Springs, V22n.

Z. Zimeramn and R. J. Henry, Bethlehem Steel Corp., U.S.A., Date Unknown, *Drawing Fine Wire On Wet Wiredrawing Machines*, pp. 242–257.

*Primary Examiner*—Daniel C. Crane

*Attorney, Agent, or Firm*—Harold M. Cohn; T. P. Lewandowski

[57] ABSTRACT

A method and device for drawing steel wire (12) through draft of multiple dies (32, 14") at several or all die positions (16'–24', 16"–24") of a wire drawing machine (30,40) to provide an increased reduction in cross area per die position (16'–24', 16"–24") without the excessive heat build up and die wear previously associated therewith. Also, a novel die (32) is disclosed with lubrication grooves (34) across the face (36) of the die casing (31) to permit liquid lubricant to reach the die/wire interface.

19 Claims, 4 Drawing Sheets

METHOD AND APPARATUS FOR DRAWING WIRE THROUGH A PLURALITY OF STANDARD DIES AT THE DIE POSITIONS

While the invention is subject to a wide range of applications, it is particularly suited for drawing metal wire into high tensile strength wire. In particular, wire is drawn through multiple dies at several or all die positions of a wire drawing machine to enable higher total drawing reductions in the cross-sectional areas of the wire without increasing the number of die positions in the machine.

The hardness of drawn steel wire results from the plastic deformation associated with the drawing process. The wire increases in hardness as it proceeds through the wire drawing machine. If the wire becomes too hard or brittle, breakage occurs during the drawing process or when the wire is subjected to torsion or bending.

The process mechanics of drawing wire are discussed in an article, "DRAWING FINE WIRE ON WET WIRE-DRAWING MACHINES" by Zimmerman, et al., described in U.S. Pat. No. 5,189,897 ('897), assigned to Goodyear Corp., the assignee of the present invention, which patent is incorporated by reference in its entirety herein. As the wire is drawn through a die to reduce its cross section, the outer fibers of the wire flow faster or at a higher velocity than those in its center causing a lesser amount of elongation at the center of the wire than at the surface of the wire. A stress differential resulting from this mechanism of elongation induces compressive, longitudinal stresses on the surface of the wire and tensile, longitudinal stresses at its center. Voids, known as central bursts, can occur in the center of the wire when the tensile stresses exceed the breaking strength of the material. The central burst effect can be prevented by controlling the process geometries.

Strain introduced into the wire by the drawing process increases the tensile strength of the wire. Preferably, this increase is held constant at every die of the draft in a wire drawing machine. Analyses of the formation of central bursts show that bursting is more likely to occur if the increase in tensile strength remains low. Therefore, the wire is drawn through a draft of many dies each having a geometry to avoid the central burst zone. Reducing the number of dies in the draft results in a higher reduction of area at each die. This in turn results in an increase in both the heat generated and die wear. To obviate these problems, the wire drawing industry is continually trying to improve the quality of wire drawn products. An ongoing search, therefore, continues for improvements in processing and/or equipment design to economically manufacture high tensile strength steel wire.

Currently, steel wires are drawn to filament diameters at a total drawing strain of between approximately 3.3 to 3.7 and typically about 3.6. While drawing wires to higher drawing strains in fine drawing machines could be advantageous when higher strengths are required from filaments of a given material, there are limitations such as wire breakage. Wire drawing machines are typically designed to draw wire through a draft of nineteen to twenty-three dies. Standard reductions in cross sectional area are approximately 15% at each die. This results in a total drawing strain of approximately 3.60. In order to increase the amount of drawing strain without increasing the number of die positions in the drawing machine, the reduction in area per die can be increased. However, there are limitations in the amount which the reduction in area per die can be increased. Excessive reduction in area at a single die, above about a drawing strain of 3.8, leads to wire breaks due to the higher frictional forces and temperatures at the interface of the wire and die. The higher frictional forces, in turn, lead to harder wire exiting the die. When the wire becomes too hard, it cannot be drawn to the desired diameter.

In the article by Zimmerman, et al. described above, for example, there is an evaluation of the data of a 1.1 millimeters (mm.) diameter wire drawn to a 0.22 mm. diameter through nineteen dies each having 12 degree included angles. The reduction at each step was about 16%. At first glance, increasing the reduction in area of wire at a die increases the speed of manufacture and reduces the number of dies needed to draw the wire to a desired size. The increase in reduction is particularly advantageous because it reduces the central bursting zone effect. Other parameters, however, such as increased heat generation and die wear, prevent the selection of an increased reduction in area for a given included die angle.

To overcome the problem of central bursting without increasing the reduction in area per die and its attendant temperature buildup, the '897 patent discloses the provision of a double die only at the last die position. The double die is used at the last die position to prevent central bursting in the filament without increasing the reduction in area per die and the accompanying higher temperature buildup. However, there is no discussion or suggestion of increasing the amount of reduction at some or all of the dies located at the remaining draft die positions because of the aforementioned problems of increased heat generation and die wear. Therefore, it is desirable to provide a method and apparatus to draw high tensile strength steel wire through a draft of dies with an increased reduction in cross area per die without excessive heat build up, surface damage, reduced ductility of the wire, excessive load on the drawing machine, and excessive die wear otherwise associated therewith.

A possible solution to the problem of maintaining reasonable reduction in area per die, while drawing the wire to higher total strains, is to add more die positions in the drawing sequence. The deficiency in this solution is that the drawing machines presently in use would have to be replaced with non-standard drawing machines incorporating the extra die positions. This is a very expensive alternative.

It is an advantage of the present invention to provide an apparatus and method of drawing steel wire that obviates one or more of the limitations and disadvantages of the described prior arrangements to draw the steel wire through multiple dies at several or all die positions of a wire drawing machine.

It is a further advantage of the present invention to provide an apparatus and method of drawing steel wire to draw high tensile strength, steel wire through a draft of dies with an increased reduction in cross area at some or all die position without the excessive heat build up and die wear otherwise associated therewith.

It is a still further advantage of the present invention to reduce the expense associated with the method and apparatus for drawing high tensile strength, steel wire through a draft of dies by drawing the steel wire through multiple dies at several or all die positions of a wire drawing machine.

It is yet a further advantage of the present invention to use multiple dies at each die position in the existing drawing machines so that the standard reduction in area per die can be maintained or even reduced while the reduction in area at each die position is increased.

Yet another advantage of the present invention is to provide lubrication grooves on the face of die casings to permit liquid lubricant to reach the die/wire interface when two or more dies casings are abutted against each other.

An additional advantage of the invention is that wired drawing, as currently done in the industry with machines that have about 22 die positions (typically three banks of 7 die positions each, and one exit die position), can now be accomplished with smaller, less expensive machines having only one bank of 10 die positions which use less floor space.

In accordance with the invention, there is disclosed a method for drawing steel wire to produce high tensile strength, steel wire which comprises the following steps. First, the wire is drawn through a plurality of die positions arranged in a wire drawing device wherein two or more of the die positions contain a plurality of dies. Preferably, two dies are located at each of the die positions. The cross section of the wire is reduced by a constant reduction of between about 15% to about 18% at each of the dies for a total of about 30% to about 36% at each of the die positions containing a plurality of dies.

Also, in accordance with the invention, a device for drawing steel wire to produce high tensile strength, steel wire with increased torsional ductility, includes a plurality of die positions arranged in a wire drawing device with two rows of die supports at each of the die positions, having the dies there between, to prevent movement of the dies in the direction which wire moves as it traverses through the wire drawing device. While at least two of the die positions contain a plurality of dies, preferably, each of the die positions contains two of the dies. In one embodiment of the invention, the dies at each of the die positions are spaced from each other. In another embodiment of the invention, the dies at the die positions are abutted against each other.

Further in accordance with the invention, a high tensile strength wire is an article of manufacture formed by the method of drawing wire, comprising the following steps. First, the wire is drawn through a plurality of die positions arranged in a wire drawing device wherein at least two and preferably each of the die positions contain a plurality of dies. Then, the cross section of the wire is reduced by a constant reduction of between about 15% to about 18% at each of the dies and a total of about 30% to about 36% at each of the die positions containing a plurality of dies.

Also in accordance with the invention, a die through which wire is drawn for reducing the cross section of the wire comprises a die casing having a central bore with a die element therein. One or more lubrication grooves are formed in the face of the die casing to permit liquid lubricant to reach the die/wire interface. The lubrication grooves consist of a rectangular, square, or triangular cross sectional configuration. The lubrication grooves can extend radially outward from the center to the outer peripheral surface of the die casing.

The invention and further developments of the invention are now elucidated by preferred embodiments shown in the drawings.

Figure 3:
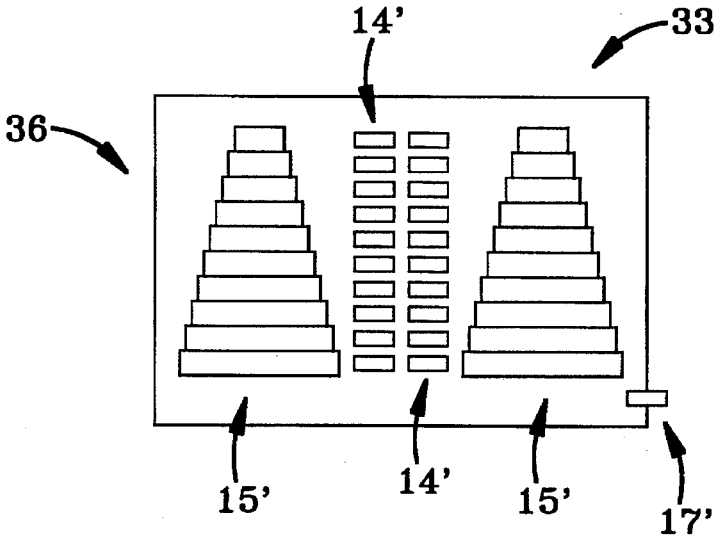
Figure 4:
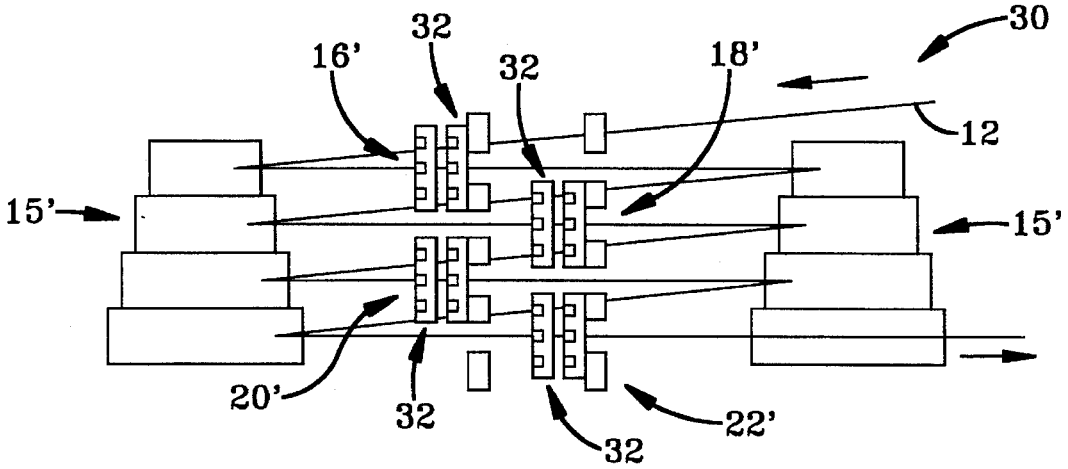
Figure 8:
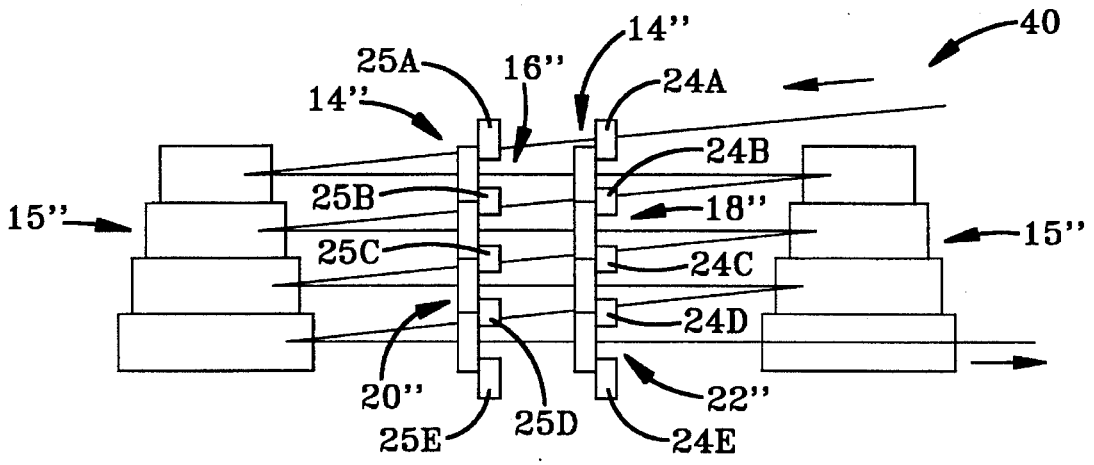
Figure 5:
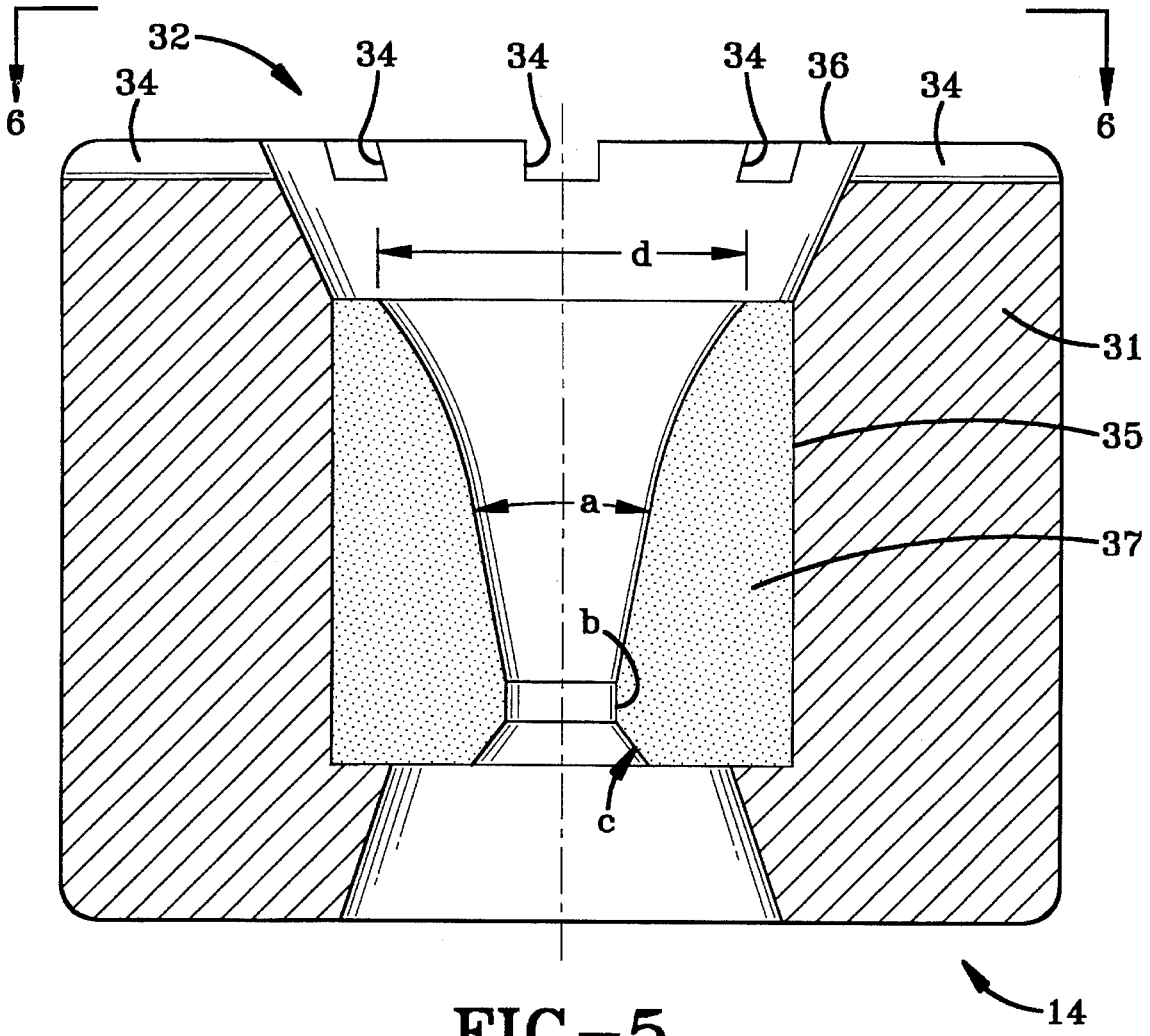
Figure 7:
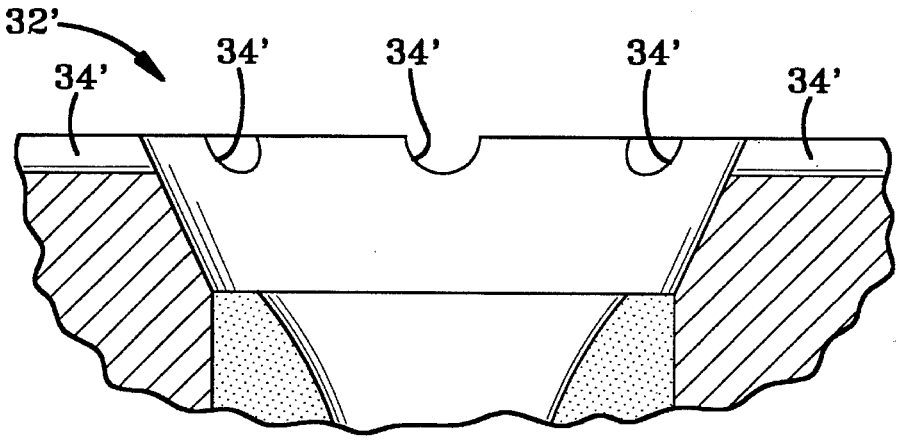
Figure 6:
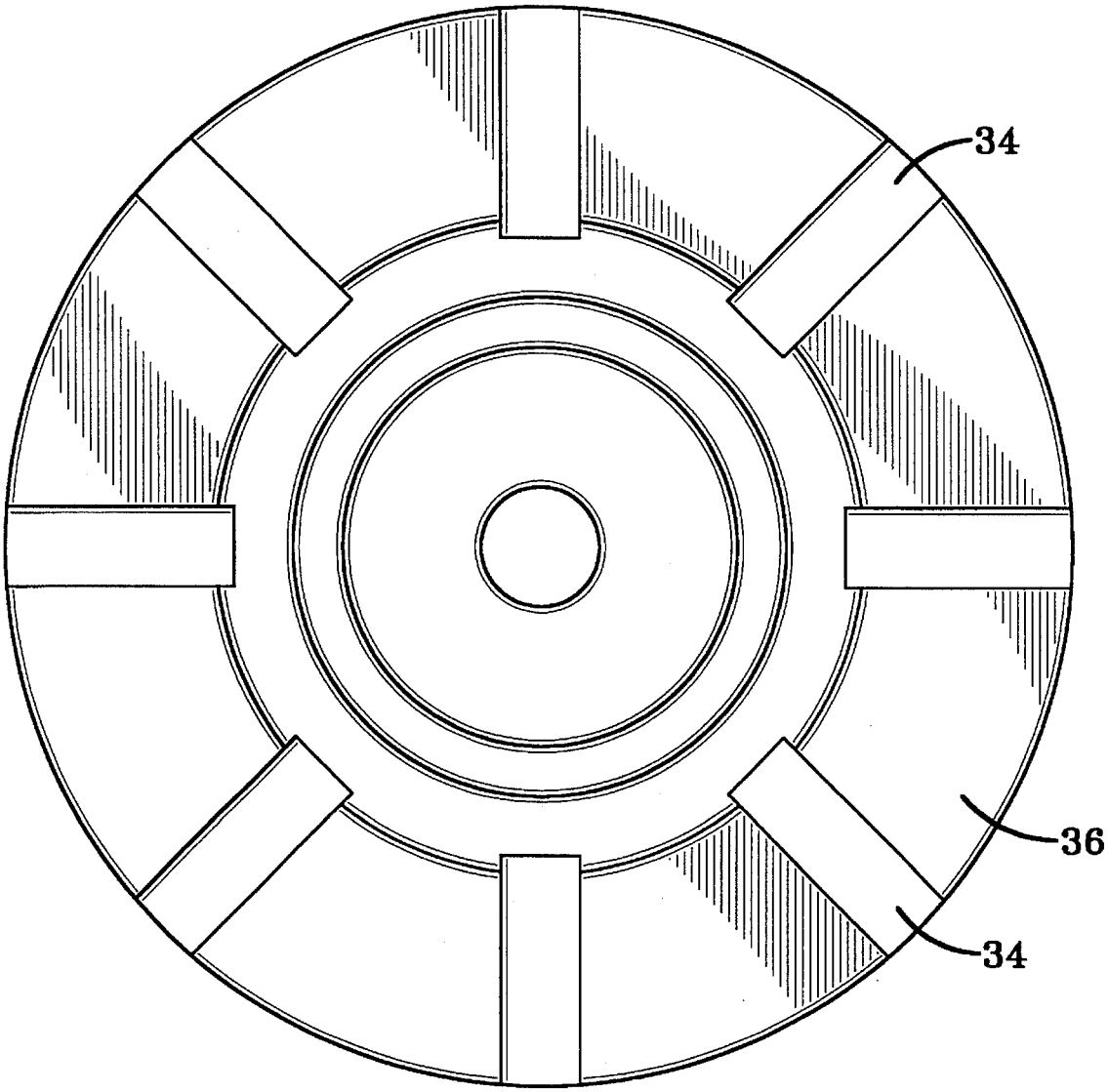

FIG. 3 is a schematic illustration of a wire drawing machine having 20 dies in one bank with 10 die positions and 2 dies at an exit position, in accordance with the present invention;

FIG. 4 is a schematic drawing of a portion of a first embodiment of a wire drawing machine, of the type shown in FIG. 3, incorporating double dies at the die positions in accordance with the present invention;

FIG. 5 is an enlarged side view, in cross section, of a standard die in accordance with the present invention;

FIG. 6 is a view through line 6—6 of FIG. 5 showing the lubrication grooves in the face of the die casing;

FIG. 7 is a partial view through line 6—6 of FIG. 5 showing an embodiment with semicircular lubrication grooves in the face of the die casing; and FIG. 8 is a schematic of drawing of a portion of a second embodiment of a wire drawing machine incorporating spaced double dies at the die positions in accordance with the present invention.

Figure 1:
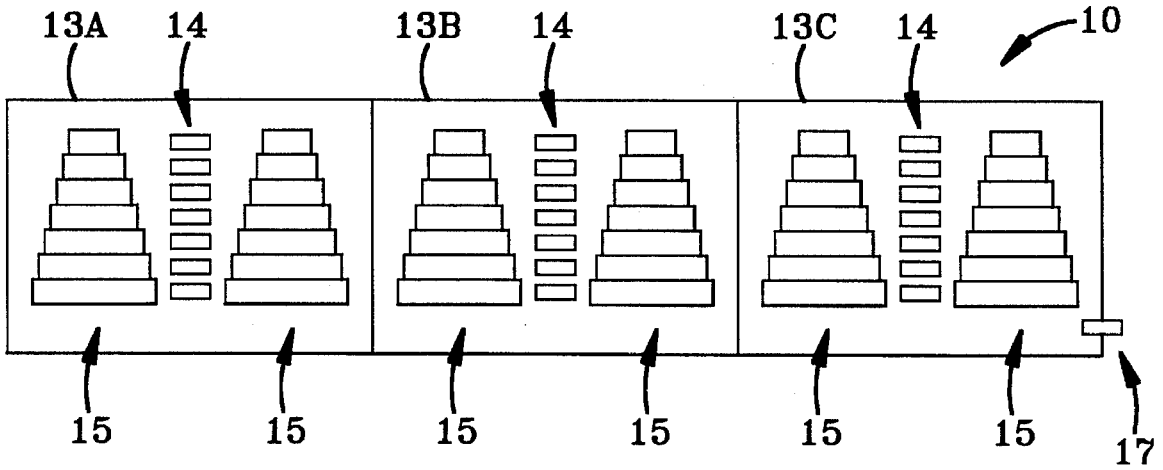
FIG-1 PRIOR ART
FIG. 1 is a schematic drawing of the capstans and dies of a prior art wire drawing device for drawing metal wire.
Figure 2:
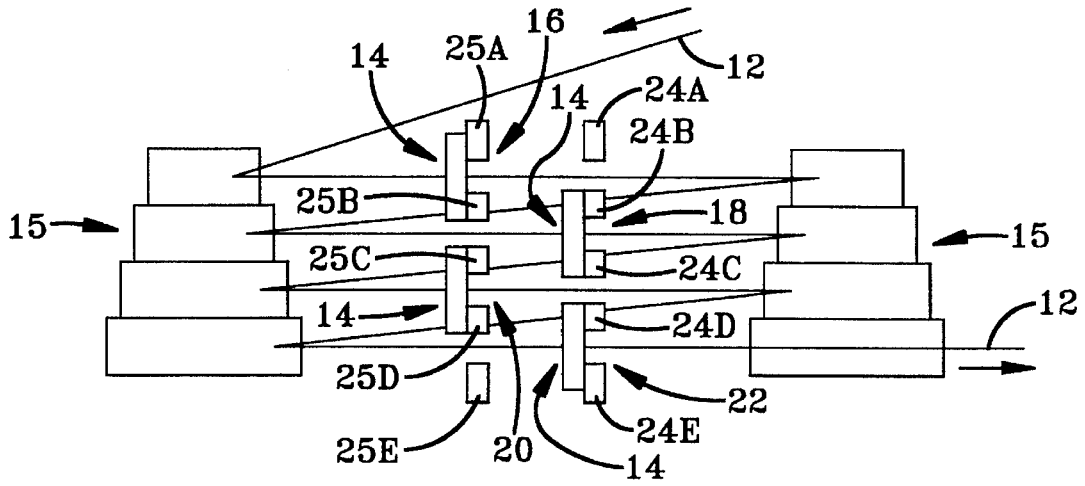
FIG-2 PRIOR ART
FIG. 2 is a schematic illustration of a prior art wire drawing machine having 22 die positions (three banks of 7 die positions each, and one exit die position)

Referring to FIGS. 1 and 2, there is shown a schematic illustration of a prior art, wire drawing device 10 to produce high tensile strength, steel wire 12. Twenty two substantially identical, standard dies 14 and twenty one drawing capstans 15 are alternately arranged in three banks 13A, 13B, 13C in device 10. In the illustrated wire drawing device 10, each bank 13A, 13B, and 13C contains seven die positions with one die 14 at each die position and one die 14 located at an exit position 17. Each of the standard dies 14 is located at a die position 16, 18, 20, 22 (16–22), as shown in FIG. 2, and abutted against a pair of spaced, adjustable die supports or brackets, 25A,25B, 24B,24C, 25C,25D, or 24D,24E, respectively, located between adjacent capstans 15. For the purpose of the present invention, the term "die position", as used in the present specification and claims, is the space between adjacent capstans 15 in which dies 14 are located. Referring to FIG. 2, while only four die positions 16–22 of the drawing device 10 are illustrated for descriptive purposes, the conventional drawing device of FIG. 1 has 22 die positions and can typically have between 19 and 23 die positions. The die supports are positioned in two rows with die supports 24A,24B,24C,24D,24E (24A–24E) in one row and die supports 25A,25B,25C,25D,25E (24A–24E) in a second row. The die supports 24A–24E and 25A–25E prevent dies 14 from moving in the direction which wire 12 moves as the latter traverses through device 10. The term "standard die" as used in the present specification and claims, refers to a die, of the type shown in FIG. 5 but without the lubrication slots as described below. The standard dies have a geometry that reduces the cross section of the wire a substantially constant amount equal to that of the other dies in a draft of the wire drawing device. The device 10 is preferably a wet, slip, wire drawing machine and dies 14 are submerged in a cooling lubricant.

The term "steel wire", as used in the present specification and claims, preferably refers to brass and or zinc-coated steel wire or filaments. The steel filaments have a very thin layer of brass, such as alpha brass, sometimes with the brass coating itself having a thin zinc layer thereon, or a ternary alloy addition, such as cobalt or nickel. The term "steel" refers to what is commonly known as carbon steel, also called high-carbon steel, ordinary steel, straight carbon steel and plain carbon steel. An example of such steel is American Iron and Steel Institute Grade 1070 -high-carbon steel (AISI 1070). Plain carbon steel typically has a tensile strength of up to about 3400 MPa. Such steel owes its properties chiefly to the presence of carbon without substantial amounts of other alloying elements. However, the tensile strength of carbon steel can be increased by small additions of alloying elements, usually less than 1.0%. These are called "micro-alloyed steels" and have a tensile strength of about 3650 to about 4000 MPa. High tensile strength steels having a high level of ductility and outstanding fatigue resistance are described in U.S. Pat. No. 4,960,473, which is incorporated in its entirety by reference herein. Brass is an alloy of copper and zinc which can contain other metals in varying lesser amounts. The ternary alloys employed as coatings in this invention are iron-brass alloys since they contain 0.1 to 10 percent iron.

In the prior device shown in FIG. 2, the wire 12 passes directly from each standard die 14 to drawing capstans 15 of different sizes and then to the next standard die. The wire 12 is wound around each of the drawing capstans 15, and as the wire diameter is reduced at each die position between capstans 15, the wire elongates. The wire is therefore drawn over capstans 15 with each succeeding capstan 15 running faster than the preceding one to compensate for wire elongation. The reduction in the cross sectional area of wire 12 between capstans 15 of device 10, having a straight draft design, is a substantially fixed or standard value. This insures a lower velocity of the wire 12 being drawn than the peripheral velocity of drawing capstans 15. The resulting positive slip insures that all portions of wire 12 are taut and that there is adequate frictional force exerted on the wire by capstans 15 to pull the wire through standard dies 14. Without this force, the loads at subsequent positions in the wire drawing device 10 are excessive and wire breakage occurs. Currently, one die 14 is placed at each die position 16–22. In one case, as described in the '897 patent, two dies are placed at the last die position only. With these methods, higher total reductions in cross-sectional areas at each die position are not possible unless the drawing machine is replaced by a non-standard machine having extra die positions.

While an exemplary configuration of the present invention has a single bank of die positions with two dies at each or at least several positions, as illustrated by FIG. 3, it is also within the terms of the invention to provide two or more banks each having a desired number of die positions (typically a total of 19 to 23) and two dies provided at each or at least a plurality of each of the die positions. The wire drawing device 30 of the present invention, as illustrated in FIG. 3, has twenty two substantially identical standard dies 14' and twenty drawing capstans 15' alternately arranged in one bank 33 with two standard dies at each of ten die positions and two dies located at an exit position.

A first embodiment of the invention, as illustrated in FIG. 4, shows a portion of wire drawing device 30 for drawing metal wire into high tensile strength, wire which is substantially identical with the section of the prior art device 10, as shown in FIG. 2, except for the provision of multiple standard dies 32 at several or all of the die positions 16'–22'. Throughout the specification primed and double primed numbers represent structure elements which are substantially identical to structure elements represented by the same unprimed number. Preferably, two standard dies 32 are provided at each of the die positions 16'–22'. While the preferred embodiment preferably provides two standard dies 32 at the die positions 16'–22' with multiple dies, it is also within the terms of the invention to incorporate three or more standard dies at some or all of the die positions.

Each standard die 32, as shown in FIG. 5, is constructed of a die casing 31 having a central bore 35 with a die element 37 therein. The die element 37 forms a die angle a, a bearing surface b, a back relief angle c, and an inlet opening diameter d. The die angle "a" of each standard die 32 is between about 8 degrees and about 16 degrees. However, it is within the scope of the invention to change the geometry and angles of die 32 to accommodate specific materials and size reductions. Each of the standard dies 32 is designed to reduce the cross section of the wire by a constant reduction of about 15% to about 18%. Therefore, in accordance with the present invention, the cross section of wire 12 is reduced by a constant reduction of about 30% to about 36% at each die position 16'–22' containing a pair of standard dies 14'. More typically, each of the dies 14' reduces the cross section of the wire by a constant reduction of about 15.5% and the cross section of wire 12 is reduced by a constant reduction of about 31% at each die position 16'–22' containing a pair of dies 14'.

In the embodiment illustrated in FIG. 4, the two or more standard dies 32 provided at each die position 16'–22' of wire drawing machine 30 can be in contact with each other as wire 12 is drawn through the dies. To insure that heat does not build up during the drawing of wire through the plurality of standard dies 32 at each position 16'–22', die 32 can be configured with one or more lubrication channels or grooves 34 formed in the face 36 of the die casings to permit the liquid lubricant to reach all die/wire interfaces. The grooves 34 can extend across the face 36 in any desired configuration, such as for example radially outward from the center of the die 32 as shown in FIG. 6, and have any desired cross section, including but not limited to a rectangular, square or semi-circular cross section, as shown in FIG. 7. Die 32 is substantially identical to die 14 except for the provision of the lubricating grooves 34. The grooves 34 allow lubricant to flow between adjacently disposed dies 32 at one die position to prevent the buildup of heat as the wire 12 passes through both dies, as shown in FIG. 4, which causes the pressing of the downstream die against the die supports and the upstream die against the downstream die. Other means of separating dies 32, such as spacers (not shown), can be placed between dies to permit lubricant to reach the die/wire interfaces.

The use of multiple standard dies 32 at several or all die positions 16'–22' enables an increased reduction in area per die position. While the reduction in area at each die position is increased with the provision of multiple standard dies 22' at each die position 16'–32', the actual reduction at each standard die 32 remains the same. Wire being manufactured in a device with multiple dies 32 at the die positions 16'–22' has increased ductility and improved surface conditions without generating excess heat buildup, as compared to wire manufactured in a prior art device, as shown in FIG. 2, with the same reduction per die but with only one die at each die position.

Referring to FIG. 8, there is illustrated a portion of an alternative embodiment of the invention shown in FIG. 3 where drawing machine 40 now includes a plurality of dies 14" at each die position 16"–22" abutted against adjacent die supports 24A–24E, 25A–25E in each row. For example, in the first die position 16", a pair of dies 14" are abutted against die supports 24A,24B and 25A,25B and in the second die position, a pair of dies 14" are abutted against die supports 24B,24C and 25B,25C. The second embodiment is advantageous because the faces of the dies 14" are not abutted each other and therefore there is no heat build up caused by the inability of heat generated at the die/wire interface to escape from between the dies which are in contact with each other, as in the embodiment illustrated in FIG. 4. While standard dies 14" do not require lubrication slots, as shown in FIG. 5 and 6, it is within the terms of the invention to substitute dies 32 for dies 14" if desired.

The present invention and its advantages will be more fully appreciated from the following examples set forth in TABLE I below comparing the prior art method of drawing wire with a single die at each die position, as illustrated in FIGS. 1 and 2, with the novel reduction with two dies at each die position, as illustrated in FIGS. 4 and 7. These examples are merely for the purpose of illustration and are not to be regarded as limiting the scope of the invention or the manner in which it may be practiced.

To provide a comparison between the standard practice and the new practice of the present invention an experiment was conducted with a standard practice wire drawing machine 10, as shown in FIG. 1. In one setup corresponding to the previous setup, 20 standard dies 14 were each located at one of 20 die positions (no dies were provided at the first die position in bank 13A). In another setup corresponding to the new setup of the present invention, 20 dies were located at only 10 die positions (none in the first bank, six at three die positions in the second bank, twelve at six die positions in the third bank and two at the exit die position). The new practice has a number of advantages, as enumerated below. These advantages include eliminating the intermediate drawing stage in wire processing. This is possible because of the ability, with the new double die configuration, to use higher total strains in the fine drawing process. This means that less drawing is required in the rough drawing and intermediate drawing stages that precede fine drawing. In fact, the intermediate drawing stage can be eliminated.

TABLE I

| Die | STANDARD PRACTICE | | Die | NEW PRACTICE | |
|---|---|---|---|---|---|
| Position | Die Size | Percent Reduction | Position | Die Size | Percent Reduction |
| 1 | 1.044 | 15.6 | | | |
| 2 | .959 | 15.6 | | | |
| 3 | .880 | 15.8 | | | |
| 4 | .806 | 16.1 | | | |
| 5 | .741 | 15.5 | | | |
| 6 | .680 | 15.8 | | | |
| 7 | .625 | 15.5 | | | |
| 8 | .574 | 15.6 | | | |
| 9 | .527 | 15.7 | | | |
| 10 | .484 | 15.6 | | | |
| 11 | .444 | 15.8 | 11 | 1.044 & .959 | 31.2 |
| 12 | .408 | 15.6 | 12 | .880 & .806 | 31.9 |
| 13 | .374 | 15.9 | 13 | .741 & .680 | 31.3 |
| 14 | .343 | 15.9 | 14 | .625 & .574 | 31.1 |
| 15 | .313 | 16.7 | 15 | .527 & .484 | 31.3 |
| 16 | .287 | 15.7 | 16 | .444 & .408 | 31.4 |
| 17 | .260 | 17.9 | 17 | .374 & .343 | 31.8 |
| 18 | .237 | 16.9 | 18 | .313 & .287 | 32.4 |
| 19 | .216 | 16.9 | 19 | .260 & .237 | 33.8 |
| 20 | .199 | 15.1 | 20 | .216 & .199 | 32.0 |

In an example of a prior art, standard process, steel rod is drawn to an intermediate size in the rough drawing stage. Then, the drawn rod is heat treated, called intermediate patenting, to remove the effects of the rough drawing. Continuing, the rod is drawn to an intermediate size, known as intermediate drawing, and heat treated again, called fine patenting, to remove effects of the intermediate drawing. Finally, the rod is fine drawn to the desired filament diameter. If the starting diameter for the fine drawing stage is large enough, the intermediate patenting and intermediate drawing stages can be completely eliminated.

In an example of the benefits of wire drawing using the set up and process of the present invention, a comparison of drawing wire through the old and new wire drawing devices is described. Using a prior art device 10, a 5.5 mm wire is rough drawn to a 3.4 mm wire, subjected to intermediate patenting and then intermediate drawn to approximately 2.0 mm wire. Continuing, the 2.0 mm wire is fine patented and drawn to 0.35 mm diameter filament. By contrast, using double dies at each of the die positions in accordance with the present invention, the 5.5 mm diameter rod is initially rough drawn to 2.6 mm diameter wire. After fine patenting, it is ready for fine drawing. Again, using two dies at each of the die positions in the fine drawing section of a wire drawing device, the 2.6 mm diameter wire can be immediately drawn to 0.35 mm diameter filament. Thus, the process of drawing wire through a device constructed in accordance with the present invention, can eliminate the intermediate patenting and drawing steps.

In another example, as shown in TABLE II, 10 standard dies were located at 10 die positions of a wire drawing machine of the type shown in FIG. 1. The dies were configured to achieve an approximate 29% reduction at each die position.

TABLE II

| Die Position | Die Size | Percent Reduction |
|---|---|---|
| 11 | .959 | 29.2 |
| 12 | .806 | 29.4 |
| 13 | .680 | 28.8 |
| 14 | .574 | 28.8 |
| 15 | .484 | 28.9 |
| 16 | .408 | 28.9 |
| 17 | .343 | 29.3 |
| 18 | .287 | 30.0 |
| 19 | .237 | 31.8 |
| 20 | .199 | 29.5 |

The resulting wire from the latter experiment could not even be strung up successfully in the drawing machine. Thus, drawing a wire from a die size of 0.959 to a die size of 0.199 mm in 10 die positions with a single die at each position was unsuccessful. By contrast, the new method and apparatus described herein does enable the drawing of similar wire using 10 die positions (with multiple dies at a plurality of the positions) without any problems.

In another example, wire made from plain carbon steel with 0.8% carbon content could not be drawn from 1.19 mm diameter to filament of 0.15 mm diameter by the regular drawing practice using a device similar to that shown in FIG. 1 because the tensile strain would be about 4.1. This is known because according to conventional practice, the total tensile strain is held between about 3.3 to about 3.7. When the tensile strain exceeds the upper value, the wire often breaks or has some other deformity. However, when a pair of dies was substituted for a single die at each of the die positions, as is the device shown in FIG. 4, the wire was successfully drawn into a filament at a total drawing strain of 4.1. Moreover, the use of the double die method of the present invention resulted in plain carbon wire having a tensile strength of about 3400 MPa, which is approximately 10–15% in excess of that normally achieved from the standard, single die device. Also with microalloy steel, a tensile strength of between about 3650 and 4000 MPa was achieved, which is approximately 10–15% in excess of what is normally achieved from the standard, single die device. Excellent torsional properties of the filament indicated good ductility and suggested ease in the cabling of the filaments.

In still another example, wire made from plain carbon steel with 0.7% carbon content is currently used to make filaments which exhibit lower tensile strength than those made from 0.8% carbon steel wire, which in turn have lower tensile strength than filaments made from microalloyed steels containing even higher levels of carbon. It is desirable to draw a rod 0.7% carbon steel into wire filaments with a strength level that is currently achieved by drawing a rod of 0.8% carbon steel into wire filaments using the current drawing device with single dies at each position. Using the plurality of dies at each die position, in accordance with the principles of the present invention, a 5.5 mm diameter rod was drawn to 2.6 mm diameter wire. The resulting wire was patented once, plated and drawn to 0.35 mm diameter filaments at a total strain of 4.02. The torsional properties of the resulting filaments was excellent and the strength level achieved was sufficient to meet requirements of not only 0.8% carbon filaments but also of filaments made from more expensive microalloyed steels with even higher carbon contents.

Besides, producing a high quality, low cost filament, the present invention represents reductions in both the material and processing costs. These advantages could not be achieved using the regular drawing practice.

While the present invention is directed to a wire drawing machine incorporating a straight draft, it is also within the terms of the present invention to substitute a wire drawing machine having a tapered draft. The advantage of a tapered draft is that the cross sectional area of the wire is reduced in a fewer number of dies. With a tapered draft, the amount of reduction in cross section of the wire would be larger at the first die position than at the corresponding die positions in the constant draft. The amount of reduction at each die position would then become increasingly less until the last few die positions.

It is apparent that there has been provided in accordance with this invention a method and apparatus of drawing metal wire to produce high tensile strength, metal wire that satisfy the objects, means and advantages set forth hereinbefore. The novel apparatus and method includes drawing metal wire through a draft of multiple dies at several or all die positions of a wire drawing machine to enable an increased reduction in cross area per die without the excessive heat build up and die wear previously associated therewith. The novel apparatus typically includes providing two dies at each die position of an existing drawing machines so that the standard reduction in area per die can be maintained or even reduced while the reduction in area at each die position is increased. Also, a novel die is disclosed with lubrication grooves across the face of the die casing to permit liquid lubricant to reach the die/wire interface.

While the invention has been described in combination with embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. A method of drawing wire, comprising the steps of:

drawing wire through a plurality of die positions arranged in a wire drawing device, two or more of said die positions each containing a plurality of dies which are arranged so that said wire is pulled first through an upstream die and then pulled substantially immediately and unrestricted through one or more downstream dies at said two or more of said die positions; and reducing the cross section of said wire by a constant reduction of between about 15% to about 18% at each of said plurality of dies and about 30% to about 36% at each of said two or more of said die positions containing said plurality of dies.

2. The method of drawing metal wire of claim 1 including the step of providing said upstream die and said one or more downstream dies at each of said plurality of die positions.

3. The method of drawing metal wire of claim 2 wherein said step of providing a said upstream die and said one or more downstream dies at each of said plurality of die positions includes the step of providing said upstream die and a downstream die at each of said plurality of die positions.

4. The method of drawing metal wire of claim 1 wherein said step of reducing the cross section of said wire by a constant reduction at each of said upstream dies and said dies is preferably by a constant reduction of about 15.5%.

5. The method of drawing metal wire of claim 3 including the step of disposing said upstream die against said downstream die.

6. The method of drawing metal wire of claim 3 including the step of mounting said upstream die and said downstream die at each of said plurality of die positions against a separate die support.

7. The method of drawing metal wire of claim 1 including the step of pulling said wire from each of said plurality of die positions with a different sized drawing capstan.

8. A device for drawing wire, comprising:

a wire drawing device having a plurality of die positions; and two or more of said die positions each having an upstream die and one or more downstream dies which are arranged so that said wire is pulled first through said upstream die and then pulled substantially immediately and unrestricted through said one or more downstream dies at said two or more of said die positions;

reducing the cross section of said wire at each of said upstream and downstream dies by a constant reduction of about 15% to about 18% whereby said cross section of said wire is reduced by a constant reduction of about 30% to about 36% at each of said die positions containing said upstream die and said one or more downstream dies.

9. The device for drawing metal wire of claim 8 wherein each of said plurality of die positions are located in a space between pairs of different sized drawing capstans.

10. The device for drawing wire of claim 9 wherein each of said plurality of die positions contains said upstream die and said one or more downstream dies.

11. The device for drawing wire of claim 10 wherein each of said plurality of die positions contains said upstream die and a downstream die.

12. The device for drawing wire of claim 11 including two rows of die supports to prevent movement of said upstream and downstream dies at each of said plurality of die positions in the direction which said wire moves as it traverses through said device.

13. The device for drawing metal wire of claim 9 wherein each of said upstream and said one or more downstream dies is constructed from a die casing having a face with one or more lubrication grooves in said face to permit liquid lubricant in said wire drawing device to reach all die/wire interfaces whenever said upstream die and said one or more downstream dies at said two or more of said die positions are abutted against each other.

14. The device for drawing metal wire of claim 13 wherein said one or more lubrication grooves include grooves that extend across said face of said upstream die and said one or more downstream dies.

15. The device for drawing metal wire of claim 14 wherein said one or more lubrication grooves consist of a rectangular, square, or semi-circular cross sectional configuration.

16. The device for drawing metal wire of claim 14 wherein said one or more lubrication grooves extend radially outward from a center to an outer peripheral surface of said upstream die and said one or more downstream dies.

17. The device for drawing metal wire of claim 11 wherein said upstream die and said downstream die at each of said plurality of die positions are spaced from each other.

18. The device for drawing metal wire of claim 12 wherein said upstream die and said downstream die at each of said plurality of die positions are abutted against adjacent die supports in one of said two rows at each of said plurality of die positions.

19. The device for drawing metal wire of claim 12 wherein said upstream and said downstream dies are abutted against adjacent die supports in one of said two rows at each of said plurality of die positions.

* * * * *